US006375090B1

(12) United States Patent
Beidokhti

(10) Patent No.: US 6,375,090 B1
(45) Date of Patent: Apr. 23, 2002

(54) BATTERY-POWERED REMOTELY CONTROLLED FLOATING POOL FOUNTAIN AND LIGHT DEVICE

(76) Inventor: Noorolah Nader Beidokhti, 16757 Maple St., Fountain Valley, CA (US) 92708

( * ) Notice: Subject to any disclaimer, the term of this patent is extended or adjusted under 35 U.S.C. 154(b) by 0 days.

(21) Appl. No.: 09/654,544

(22) Filed: Sep. 1, 2000

(51) Int. Cl.[7] ..... B05B 17/08

(52) U.S. Cl. ..... 239/17; 239/16; 239/18; 239/20; 239/23; 239/211; 239/22; 239/67; 239/DIG. 15

(58) Field of Search ..... 239/16, 17, 18, 239/20, 22, 23, 211, 67, 93, 101, 578, DIG. 15

(56) References Cited

U.S. PATENT DOCUMENTS

| | | | | | |
|---|---|---|---|---|---|
| 2,745,697 | A | * | 5/1956 | Pearse | |
| 3,088,675 | A | * | 5/1963 | Bone | |
| 4,705,216 | A | * | 11/1987 | Kaffka et al. | 239/18 |
| 4,920,465 | A | * | 4/1990 | Sargent | 362/96 |
| 5,510,022 | A | * | 4/1996 | Mullis | 417/61 X |
| 5,918,809 | A | * | 7/1999 | Simmons | 239/17 |
| 6,179,218 | B1 | * | 1/2001 | Gates | 239/17 |
| 6,206,298 | B1 | * | 3/2001 | Ting | 239/20 |

* cited by examiner

*Primary Examiner*—Robin O. Evans
(74) *Attorney, Agent, or Firm*—Roy A. Ekstrand

(57) ABSTRACT

A housing defines a sealed interior cavity to provide buoyancy for floating the housing in water. A battery housing secured to the buoyant housing supports a rechargeable battery and maintains the vertical alignment of the buoyant housing. An upper plate on the buoyant housing supports a plurality of upwardly directed lights and fountain nozzles together with a plurality of manually actuatible switches. An internal battery-powered pump mechanism is operative within the buoyant housing to draw water into the buoyant housing and force it upwardly through the fountain nozzles to produce vertically directed fountain sprays. The fountain sprays may be illuminated by the light assemblies supported by the upper plate. A remote control receiver and control circuit is supported within the buoyant housing and receives operative control signals from a handheld remote control unit. A rotation valve is operatively coupled to the pump output and provides an optional laterally directed water spray component tending to rotate the entire fountain unit. The water spray height of the fountain sprays may be adjusted by a bypass valve supported within the buoyant housing. In an alternate embodiment, a tether and anchor are securable to the unit to fix its position within a swimming pool. In a still further alternate embodiment, an annular spacer ring is securable to the buoyant housing by a collar and plurality of spokes.

24 Claims, 5 Drawing Sheets

59
58
49
48
30
16
11
12
14
15
2
52
51
35
25
54
32
22
21
24
33
34
50
23
66
69
68
64
67
61
65
60
87
62
63
85
40
10
20
75
2
41
43
13
44

FIG. 3
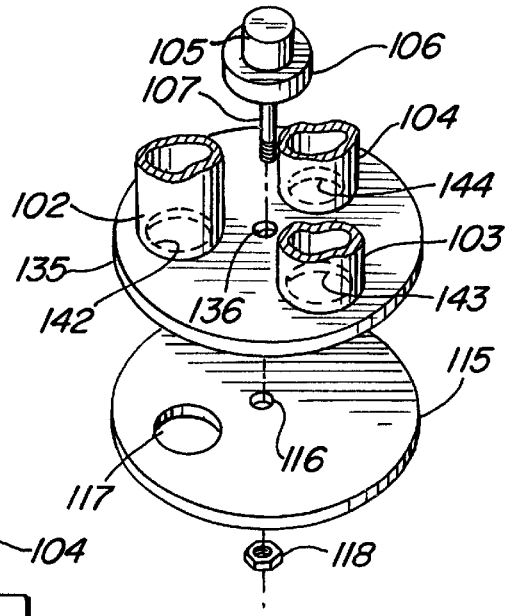
FIG. 4
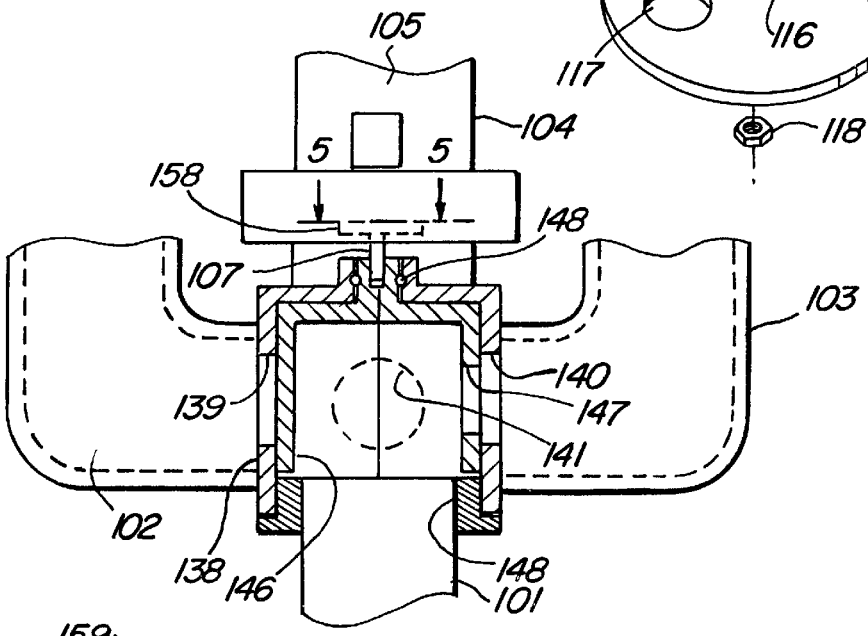
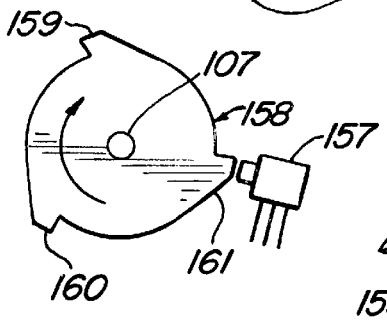
FIG. 5
FIG. 8
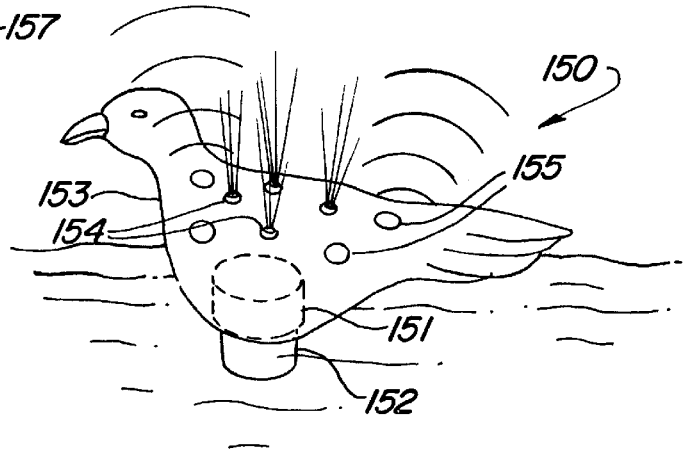

BATTERY-POWERED REMOTELY CONTROLLED FLOATING POOL FOUNTAIN AND LIGHT DEVICE

FIELD OF THE INVENTION

This invention relates generally to apparatus for use in connection with pools and particularly to apparatus which provided aesthetic enhancement of pools using fountains and decorative lights. While the present invention apparatus may be used in virtually any pool, it is particularly advantageous and particularly directed toward use in swimming pools.

BACKGROUND OF THE INVENTION

Swimming pools provide substantial relaxation and enjoyment as well as healthful exercise and activity. In addition, swimming pools also provides aesthetic enhancement of their environments. This is particularly true of swimming pools used in residential situations such as single family homes and apartment or condominium complexes. In many instances, homeowner's in the process of landscaping and planning their backyards and patio areas virtually center the decoration and landscaping about the swimming pool. In response to the consumer sensitivity to the aesthetic qualities of swimming pools, practitioner's in the pool arts have brought forth various attractive features to enhance the appeal of their respective swimming pool products. These features have included attractive shapes of the pools themselves as well as attractive cooperating patio and sidewalk materials. In addition, practitioners have provided various decorative lights and water flow features such as water falls or the like in designing and constructing swimming pools. In some instances these water fall features have been further enhanced by fountain apparatus. In a typical swimming pool fountain apparatus, one or more fountain nozzles are supported in the pool area or within the pool itself and are coupled to the high pressure side of the water filtration and circulation pump system.

Despite the attractiveness of fountains and other features in swimming pools, the relatively high-cost and need for installation during pool construction has greatly limited the number of swimming pools having such apparatus.

In response to the continuing need and desire on the part of swimming pool owners for aseptic features such as fountains or the like, practitioner's in the pool arts have provided a variety of swimming pool fountain devices which are capable of installation in swimming pools after construction. Typically, these swimming pool fountain devices utilize a floating unit supporting a plurality of lights and fountain nozzles. The floating unit is further coupled to the high pressure portion of the pool filter pump system. For example, U.S. Pat. No. 4,088,880 issued to Walsh sets forth a DECORATIVE FOUNTAIN especially adapted for use in a swimming pool. The fountain is adapted to float at the surface of the pool and incorporates a sealed beam light bulb for illumination of the fountain display. A self contained source of electric current for the light bulb is also supported within the floating unit. The fountain portion is coupled to the high pressure portion of the swimming pool filter pump system by a flexible hose.

U.S. Pat. No. 4,416,420 issued to Tompson sets forth a PORTABLE FOUNTAIN FOR POOLS OR SPAS having a pedestal supporting an upright tube within the pedestal which in turn supports an upwardly directed nozzle. The lower end of the tube is coupled to a flexible hose which in turn in coupled to the high pressure side of the swimming pool filter system.

U.S. Pat. No. 4,305,117 issued to Evans sets forth an ARTIFICIAL ILLUMINATION OF ORNAMENTAL WATER FOUNTAINS WITH COLOR BLENDING IN RESPONSE TO MUSICAL TONE VARIATIONS in which three sets of lamps in different colors are independently controlled during the playing of the musical number. The response of the lamps produces a multitude of different colors reflected by the fountain in response to the amplitude and frequency of the musical tones.

U.S. Pat. No. 4,920,465 issued to Sargent sets forth a FLOATING FOUNTAIN DEVICE for use in a swimming pool having a fountainhead to create a water fountain and a lamp and generator to illuminate the fountain. The generator is sealed within an envelope and driven by a water turbine through a magnetic coupling.

U.S. Pat. No. 5,718,379 issued to Cramer sets forth a LOW PROFILE FOUNTAIN having a submersible motor and pump secured to a frame to provide a relatively low profile. The pump motor is supported at the front end of the frame and extends generally horizontally. The pump is secured to the frame in front of the motor and includes an impeller mounted in a first pump chamber to draw water into the pump chamber and direct water upwardly through a plurality of fountain heads.

U.S. Pat. No. 5,040,726 issued to Dimitri sets forth a SOLAR ENERGY POWERED WATER FOUNTAIN having a submersible pump within a water filled container and a solar panel. The solar panel is removably connected in an electrical circuit relationship with the pump for controlling pump operation. The amount of water discharged from the pump and the display patterns produced by the pump are directly responsive to variations in light level at the solar panel.

U.S. Pat. No. 4,936,506 issued to Ryan sets forth a SWIMMING POOL FOUNTAIN configured for installation within a swimming pool, spa, hot tub or the like. The fountain is secured to high pressure side of the filtration system and may include discharge apparatus having shapes such as animals or the like.

U.S. Pat. No. 3,889,880 issued to Rhuby, Jr. sets forth a FLOATING FOUNTAIN having a submerged vertical support coupled to the high pressure side of the pool filter system pump at its lowered end and supporting a generally oval water flow conduit at its upper end. A fountain nozzle is supported upon the upper end of the fluid conduit together with a pair of floats and a plurality of upwardly directed lights.

U.S. Pat. No. 3,814,317 issued to Rhuby, Jr. sets forth ILLUMINATED WATER FOUNTAINS having a submerged support base further supporting an upwardly directed fountain nozzle. The base also supports a plurality of upwardly directed lights.

While the foregoing described prior art devices have to some extent improved the art and in some instances enjoyed commercial success, they remain subject to substantial limitations in their attractiveness of use. Most particularly, there need to couple to the high pressure side of the swimming pool filter system and in some instances, electrical connection to external electrical power sources places undesired hoses and/or wires upon the pool bottom surfaces. With the prevalent use of cleaning apparatus such as automated pool cleaners, these coupling hoses and/or electrical wires become extremely undesirable. In essence, the pool owner is not able to operate a conventional automated pool cleaner without removing the fountain device and its coupling structure. In most houses having a swimming pool, the filtration pump is located a short distance from the pool. Thus, the pump sound can be heard around the pool area. This makes the existing fountains which use the pump for water flow undesirable. There remains therefore a need in the art for evermore improved and effective pool fountain apparatus.

SUMMARY OF THE INVENTION

Accordingly, it is a general object of the present invention to provide an improved pool fountain apparatus. It is a more particular object of the present invention to provide an improved pool fountain apparatus which accommodates the use of automated pool cleaners. It a still more particular object of the present invention to provide an improved pool fountain apparatus which avoid the need for coupling to the filtration system and/or sources of electrical power through the use of coupling hoses and electrical wires.

In accordance with the present invention there is provided a pool fountain for use in a pool of water, the pool fountain comprising: a flotation housing having buoyancy for floating in water; a battery housing, supported by the flotation housing, having a battery power supply; a pump motor and pump supported within the flotation housing, the pump drawing water into the flotation housing and producing a pressurized water flow when the pump motor is activated; a water spray mechanism supported within the flotation housing coupled to the pump directing the pressurized water flow upwardly to produce an upwardly directed fountain spray; a light source supported by the flotation housing coupled to the batter power supply and operative to illuminate the fountain spray; a controller supported within the flotation housing having means for receiving control signals and for operating the pump motor and the light source; and a remote control unit for producing the control signals. The unit is controlled either by switches on the unit or via a remote control link.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 3 sets forth a partial section perspective assembly view of the fountain control of the apparatus of the present invention pool fountain;

FIG. 4 sets forth a partial section view of an alternate embodiment of the water flow control portion of the present invention;

FIG. 5 sets forth a section view of the alternate embodiment of FIG. 4 taken along section lines 4—4 therein;

FIG. 8 sets forth an alternate embodiment of the present invention pool fountain configured to resemble an animal.

DESCRIPTION OF THE PREFERRED EMBODIMENT

Figure 1:
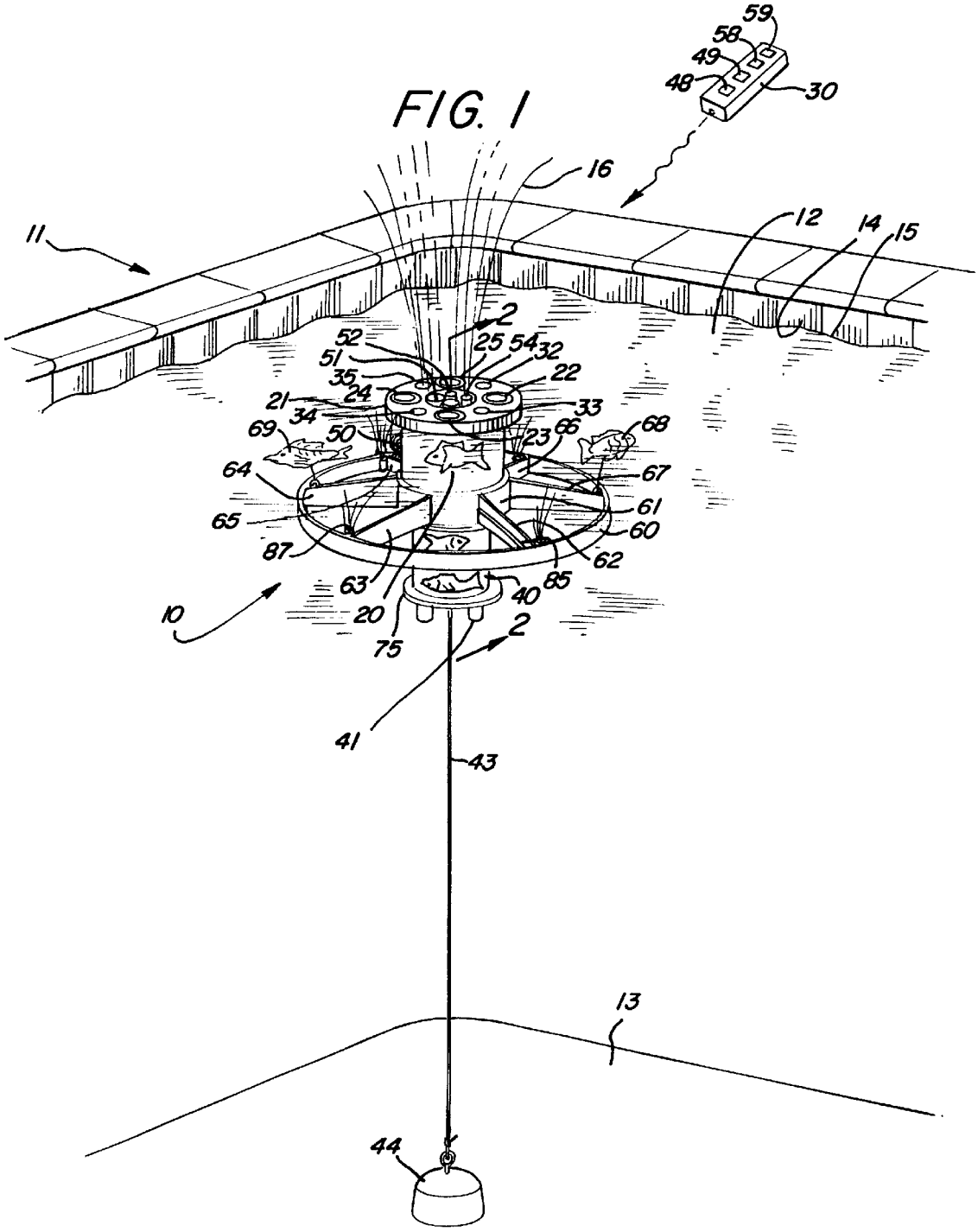
FIG. 1 sets forth a perspective view of a battery-powered remotely controlled pool fountain apparatus constructed in accordance with the present invention situated in a typical pool environment.

FIG. 1 sets forth a battery-powered remotely controlled floating pool fountain and light device constructed in accordance with the present invention and generally referenced by numeral 10. Pool fountain 10 is found received within a conventional swimming pool generally referenced by numeral 11. Pool 11 is fabricated in accordance with conventional fabrication techniques and includes a vertical pool wall 14 and a bottom surface 13. In further accordance with conventional fabrication techniques, pool 11 supports a quantity of water 12 defining a water surface 15.

In accordance with the present invention, fountain 10 includes a floating unit having a generally cylindrical housing 20 supporting a battery housing 40 and an upper plate 21. Upper plate 21 supports a plurality of upwardly directed light assemblies 22, 23, 24 and 25 together with a plurality of depressible switch assemblies 32, 33, 34 and 35. In addition, upper plate 21 supports a trio of upwardly directed fountain nozzles 51, 52 and 53. A vent valve 54 is further supported upon upper plate 21. Housing 20 further supports a rotation valve 50 operative in the manner set forth below to provide axle rotation of fountain 10 when desired.

Battery housing 40 includes a lower plate 75 supporting a plurality of downwardly extending rest elements 41. In addition, by means better seen in FIG. 2, lower plate 75 includes an attachment 42 which secures the upper end of a flexible tether 43. The lower end of tether 43 is secured to an anchor 44 which rests upon bottom surface 13.

In the configuration shown in FIG. 1, fountain 10 is shown supporting an optional spacer ring 60 which is securable to housing 20 by a cylindrical collar 61. Collar 61 is joined to spacer ring 60 by a plurality of radially extending spokes 62, 63, 64, 65, 66 and 67. To enhance the aesthetic appeal of fountain 10, a plurality of simulated fish-shaped objects 68 and 69 are secured to spacer ring 60 by flexible cords. In their preferred fabrication, simulated fish 68 and 69 are extremely decorative and colorful and exhibit a positive buoyancy causing them to freely float about their respective attachments to spacer ring 60. The housing of fountain 10 can be made with decorative photo-luminescent paint or materials to glow at night.

In further accordance with the present invention, fountain 10 includes a remote control 30 operative in accordance with conventional fabrication techniques to communicate radiated signals which, by means set forth below in greater detail, are received by fountain 10 to control the operation thereof.

In operation, and by means set forth below in greater detail, fountain 10 is operative to produce a selected plurality of upwardly directed water sprays forming fountain sprays 16 in response to actuation of any one of switches 32 through 35 or in response to actuation of remote control 30. In addition, and by means also set forth below in greater detail, fountain 10 responds to remote control 30 to activate one or more of light assemblies 22 through 25 to produce upwardly directed light beams which illuminate fountain spray 16. In the preferred fabrication of the present invention, light assemblies 22 through 25 support color tinted lens such as lens 27 shown in FIG. 2. As a result, the color of illumination of fountain spray 16 may be altered by selective activation of one or more of light assemblies 22 through 25. As mentioned, fountain 10 is free floating within water 12 and if desired, fountain 10 can be maintained at a general position by tether 43 and anchor 44. Battery housing 40 supports a battery power supply (seen in FIG. 2) for providing operative power to an internal pump (pump 90 shown in FIG. 2) to produce upwardly directed fountain sprays 16. In addition, battery housing 40 and the internal battery 70 (seen in FIG. 2) therein provides the desired weight distribution for fountain 10 which ensures that fountain 10 floats in the upright position shown. Toward this end, housing 20 defines an interior cavity 26 (seen in FIG. 2) which produces the desired flotation buoyancy for fountain 10.

In operation, fountain 10 freely floats with water 12 of swimming pool 11 and is maintained in general location by tether 43 and anchor 44. As fountain 10 floats within pool 11, the user is able to activate and control the operation of fountain 10 entirely through the use of remote control 30. Thus, remote control 30 allows the user to operate fountain 10 without requiring any direct contact therewith. This is particularly desirable when, and if, fountain 10 is positioned a substantial distance from the outer walls of pool 11.

By way of further variation of operation, tether 43 and anchor 44 may be disconnected from fountain 10 and removed leaving fountain 10 in a free floating configuration. When tether 43 and anchor are not in use, fountain 10 is able to gently float about with pool 11 providing a further enhancement of fountain operation. In addition, the removal of tether 43 and anchor 44 allows the automatic pool cleaning apparatus (not shown) within pool 11 to remain operative and prevents any interference with pool cleaner operation by fountain 10. As mentioned above, spacer ring 60 supported upon housing 20 by collar 61 is an optional accessory for the use of fountain 10. In a tethered configuration such as shown in FIG. 1, the need for spacer ring 60 is minimized. However, with a freely floating use of fountain 10, such as occurs when tether 43 and anchor 44 are removed from fountain 10, the use of spacer ring 60 becomes highly desirable. In essence, spacer ring 60 ensures that fountain 10 does not come to close to any of the exterior pool walls such as pool wall 14 during its freely floating operation. The extension of spokes 62 through 67 and the outer positioning of ring 60 cause spacer ring 60 to contact the pool wall as fountain 10 approaches it and thereby maintain a minimum distance between fountain 10 and the pool wall. This has been found particularly advantageous in situations in which the user desires to avoid transferring water which is upwardly sprayed in fountain spray 16 onto the surrounding walkways and patio surfaces which are generally adjacent pool 11.

In accordance with a further variation of the operation of fountain 10, and by means set forth below in greater detail, fountain 10 when operating in freely floating configuration may be caused to rotation by opening rotation valve 50. As is described below, the opening of rotation valve 50 allows a small portion of the pressurized water being pumped upwardly to form spray 16 to be directed laterally on one side of fountain 10 causing a slow rotation of the fountain unit.

Thus, the present invention battery-powered remotely controlled floating pool fountain and light device is capable of complete remote controlled operation and is freely floating and independent. Accordingly, interference with pool cleaning equipment such as automatic cleaners is avoided. In the preferred fabrication of the present invention, the internal battery supply within fountain 10 may be replaced or recharged by simply removing the entire fountain unit from the pool and securing a conventional battery charger (not shown) thereto. The fountain unit of the present invention may also be controlled manually by actuation of any one of a plurality of switches 32 through 35 supported upon upper plate 21 of the fountain unit. By means set forth below in greater detail, the particular type of fountains spray produced by fountain 10 may be adjusted by selection of one of the plurality of upwardly directed fountain nozzles supported upon the unit. The operation of this fountain spray selection is set forth below in FIGS. 2 and 3 in greater detail. However, suffice it to note here, that a simple selection valve mechanism is operative within housing 20 to direct water under pressure through any one of the selected fountain nozzles.

By means set forth below in FIG. 2 in greater detail, the upwardly directed fountain spray of fountain 10 may be adjusted 37 in spray elevation or spray height by operation of a manually controlled spray adjustment valve (valve 55 shown in FIG. 2). A ballast weight 84 is supported within housing 20 to balance the unit in an upright position. The shape, weight and location of ballast 84 may be varied for different units as needed.

Figure 2:
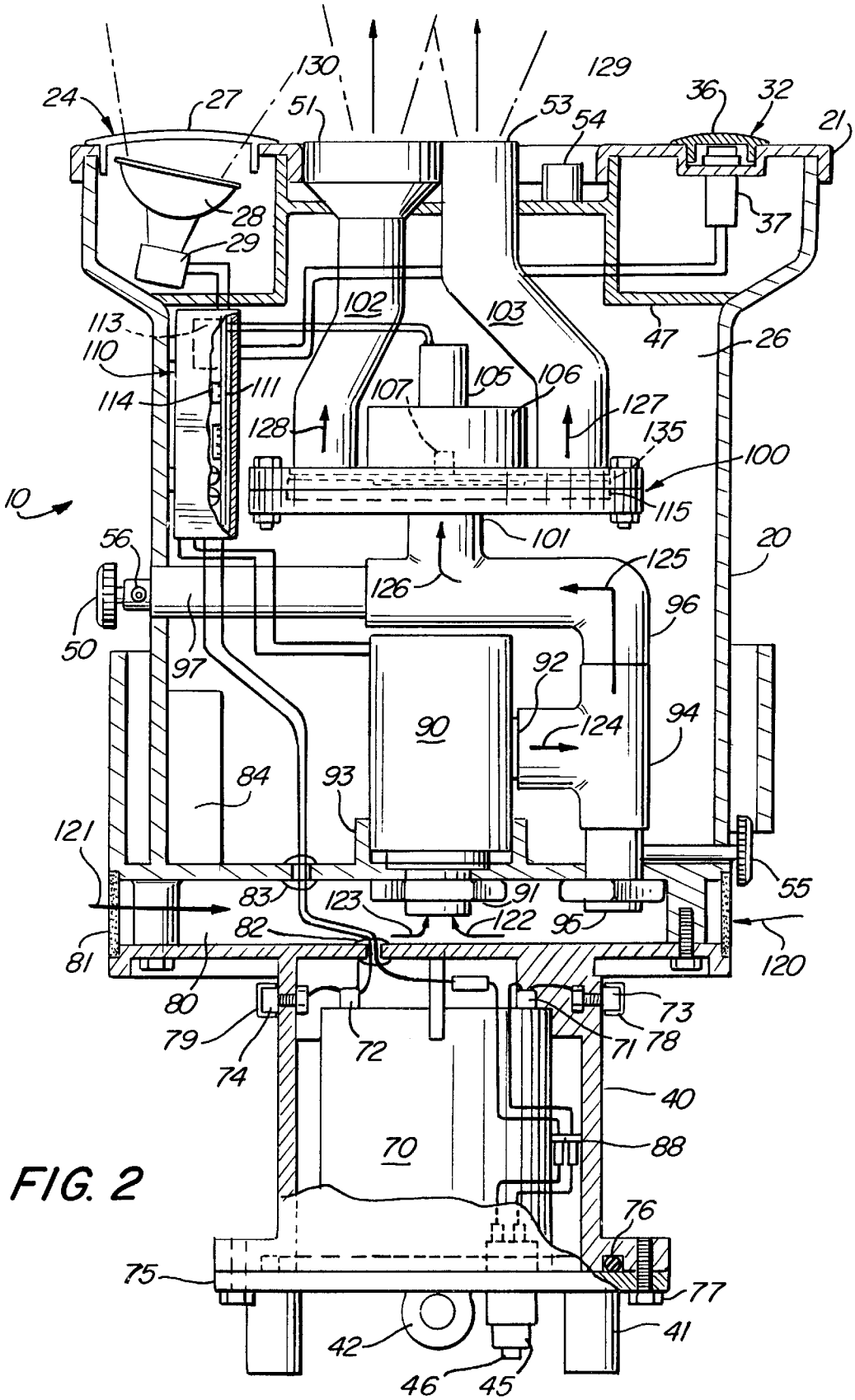
FIG. 2 sets forth a section view of the pool fountain apparatus of FIG. 1 taken along section lines 2—2 therein.

FIG. 2 sets forth a section view of fountain 10 taken 2 along section lines 2—2 in FIG. 1. As described above, fountain 10 includes a generally cylindrical housing 20 supporting an upper plate 21 and coupled to a battery housing 40. Battery housing 40 includes a lower plate 75 supporting a plurality of downwardly extending rest members 41 and a master switch 45 having an actuator 46. Lower plate 75 also supports an attachment 42 utilized in securing tether 43 to anchor 44 in the manner shown in FIG. 1. Master switch 45 is a normally closed switch which operates as a safety switch to ensure that the unit is inoperable when rested upon legs 41 and is operative when the unit is floating. When removing lower plate 75 to replace battery 70, connector 88 attached to housing 40 disconnects battery power. Connector 88 will be reconnected when lower plate 75 is reinstalled.

Housing 20 further defines an interior cavity 26 which in accordance with the preferred fabrication of the present invention, is sealed to form a water tight buoyant structure for housing 20. Conversely, battery housing 40 supports a rechargeable battery 70 having a pair of battery terminals 71 and 72. Battery housing 40 further supports a pair of battery connectors 73 and 74 operatively coupled to battery terminals 71 and 72 respectively. Connectors 73 and 74 provide access to battery 70 for purposes of recharging. Battery connectors 73 and 74 in turn support seal cap 78 and 79 respectively. Caps 78 and 79 prevent electrical contact between battery connectors 73 and 74 and the surrounding water in order to prevent battery discharge through the water.

Housing 20 further defines an intake chamber 80 positioned beneath housing 20 having an annular filter 81 supported thereon. Filter 81 is preferably formed of a porous filter material suitable for preventing waterborne particles and objects from being drawn into intake chamber 80 in the operation of fountain 10 described below. Intake chamber 80 further includes a pair of resilient seals 82 and 83 which maintain the water tight character of intake chamber 80. A seal 76 is supported by lower plate 75 of battery housing 40 and cooperates with fasteners 77 to maintain the water tight seal of battery housing 40 to prevent water damage to battery 70.

Fountain 10 further includes a support 93 formed on the lower end of housing 20 having a motor and pump combination 90 supported thereon. Motor and pump combination 90 is fabricated in accordance with conventional fabrication techniques to provide an electrically driven pump capable of drawing water from intake chamber 80. Accordingly, motor and pump 80 includes an intake 91 extending downwardly into intake chamber 80. Motor and pump combination 90 further includes an output 92 coupled to a tee fitting 94. Fitting 94 has one side coupled to a downwardly extending return which passes into intake chamber 80 and a remaining side joined to a coupler 96. A spray height adjustment valve 55 is supported within return 95 and is fabricated in accordance with conventional fabrication techniques. Coupler 96 includes an upwardly extending housing input 101 and a laterally extending portion forming a coupler 97. Coupler 97 receives a rotation valve 50 which includes a laterally disposed discharge port 56.

Input 101 of coupler 96 is joined to a spray housing 100. Spray housing 100 is generally cylindrical in shape and is formed by a pair of plates secured by conventional fasteners. Within spray housing 100, a rotating plate 115 and a tube plate 135 are supported. By means set forth below in greater detail, rotating plate 115 is rotatable supported within spray housing 100 by a shaft 107. A gear drive unit 106 is secured to the upper side of spray housing 100 by conventional attachment (not shown) and includes shaft 107 as an outward shaft. Suffice it to note here, that shaft 107 passes through to plate 135 and is secured to rotating plate 115 by a conventional fastener. A motor 105 is secured upon and operatively coupled to gear unit 106 such that energizing of motor 105 produces a corresponding rotation of shaft 107. The rotation of shaft 107 in turn causes rotation of rotating plate 115. The operation of plates 135 and 115 together with drive gear unit 106 is described below in FIG. 3 in greater detail. Suffice it to note here, that each time motor 105 is energized, rotating plate 115 is caused to rotate at a reduced speed through the action of drive gear unit 106.

Spray housing 100 further includes a plurality of upwardly extending nozzle tubes 102, 103 and 104 (tube 104 seen in FIG. 3). Nozzle tubes 102, 103 and 104 terminate in upwardly extending spray nozzles supported by support bracket 47 which in turn is supported by housing 20. For example, nozzle tube.102 terminates in a broadly directed spray nozzle 51 while nozzle tube 103 terminates in a more narrowly dispersed fountain nozzle 53. As is better seen in FIG. 1, nozzle tube 104 terminates in a spray nozzle 53.

Fountain 10 further includes a vent valve 54 constructed in accordance with conventional fabrication techniques, and configured to maintain a normally open condition so long as vent valve 54 is not placed beneath water. In the event water reaches the upper portion of vent valve 54, the valve closes to avoid the introduction of water into interior cavity 26 of housing 20.

As is seen in FIG. 1, upper plate 21 supports a plurality of switch units 32, 33, 34 and 35. As is also seen in FIG. 1, upper plate 21 supports a plurality of light assemblies 22, 23, 24 and 25. Returning to FIG. 2, switch unit 32 is shown in section view and will be understood to be identical to switch units 33, 34 and 35. Thus, the descriptions set forth herein of switch unit 32 will be understood to be equally explicable to switch units 33, 34 and 35. Similarly, FIG. 2 shows a section view of light assembly 24. However, it will be understood that light assembly 24 is substantially identical to light assemblies 22, 23 and 25 shown in FIG. 1. Accordingly, the descriptions set forth below in connection with light assembly 24 will be understood to apply equally well and be equally descriptive of light assemblies 22, 23 and 25 shown in FIG. 1.

Switch unit 32 maintains a resilient seal 36 providing closure of upper plate 21 and preventing water from entering into the interior of switch unit 32. A push button switch 37 is fabricated in accordance with conventional fabrication techniques, and is positioned beneath seal 36. Accordingly, a downward force applied to seal 36 will deform seal 36 and allow switch 37 to be actuated.

Light assembly 24 includes a lens 27, which in the preferred fabrication of the present invention, is tinted to a desired color. Lens 27 provides a liquid tight seal of light assembly 24. Light assembly 24 further includes a socket 29 supported by conventional support means (not shown) and having a light bulb 28 supported therein. Bulb 28 may be fabricated entirely in accordance with conventional fabrication techniques and preferably includes a some what focused or "flood-like" type bulb.

A control circuit 100 having a printed circuit 111 fabricated in accordance with conventional fabrication techniques is supported within interior cavity 26. Control circuit 100 is shown in schematic detail in FIG. 6 and includes a conventional remote control integrated circuit 114 and a motor control integrated circuit 112. Additional components are supported upon printed circuit board 111. In further accordance with conventional fabrication techniques, an antenna 113 is supported upon printed circuit 111 and is operatively coupled to remote control circuit 114.

Control circuit 110 may be fabricated in accordance with conventional fabrication techniques and is operatively coupled to motor 105, motor and pump unit 90, battery 70, switch units 32 through 35 and light assemblies 22 through 25 by conventional connecting wires. Control circuit 110 provides response to remote control unit 30 (seen in FIG. 1) as signals transmitted by remote control unit 30 are received by antenna 113. The operative circuitry for remote control unit 114 may be entirely conventional in fabrication and may utilize virtually any remote control unit and remote control receiver combination to provide the communication of a set of control signals to which control circuit 110 may respond. While a variety of remote control command sets and combinations may be used in the present invention fountain without departing from the spirit and scope of the present invention, it has be found advantageous to provide the following functions: a pump on/off function, a light on/off, a fountainhead selection, and a light selection. In response to each of these commands received by antenna 113 from remote control 30, or by manual activation using switches 32, 33, 34 and 35 (seen in FIG. 1), control circuit operates light assemblies 22 through 25 and motor and pump unit 90 as well as motor 105.

More specifically, each time control circuit 110 receives an pump on or pump off signal from remote control 30, motor and pump 90 is changed between on and off states. Motor 105 is energized by the pump on/off switch to periodically switch the water flow through spray housing 100 producing a repeated sequence of fountain spray changes between nozzles 51, 52 and 53 (seen in FIG. 1). Each time control circuit 110 receives a fountainhead selection signal either from remote control 30 or switches 32 through 35, the changing of spray nozzles stops at the then current fountain spray. The repeated spray change is resumed when the next fountainhead control signal is received.

The operation of spray housing 100, motor 105 and drive gear unit 106 is set forth below in greater detail. Suffice it to note here, that upon power up motor 105 is actuated and the water flow is sequentially and continuously switched between fountain nozzles 51, 52 and 53. When a fountainhead selection signal is received, the flow remains at the current fountainhead. In a similar manner, lights 22 through 25 are sequentially energized until a light on/off signal is received from remote control 30. At that point, the currently active one of light assemblies 22 through 25 remains on. When the next light selection signal is received, the sequential activation of light assemblies 22 through 25 is restored.

In the preferred embodiment of the present invention, the rate of sequential changes of lights 22 through 25 is different from the rate of change between fountainhead nozzles 51 through 53. This allows different color illuminations of each fountain over time to improve the beauty of lighted fountain sprays.

In operation, the energizing of motor and pump 90 causes water to be drawn inwardly in the directions indicated by arrows 120 and 121 through filter 81 into intake chamber 80. Thereafter, water flows upwardly in the directions indicated by arrows 122 and 123 through intake 91. Water thereafter is forced outwardly through output 92 in the direction indicated by arrow 124 under substantially increased pressure. The water flow in forced upwardly through coupler 96 as indicated by arrows 125 and 126 into spray housing 100. Thereafter, the water flow continues upwardly through the selected one of nozzle tubes 102 through 104 as indicated by arrows 127 and 128. This upwardly directed water is forced through the corresponding one of fountain nozzles 51, 52 or 53 (nozzle 52 seen in FIG. 1) in the directions indicated by arrows 129 and 130.

In addition, the user may open rotation valve 50 to provide a supplemental water flow component outwardly through discharge port 56. The horizontal orientation of discharge port 56 causes a correspondingly horizontal jet of water to exit port 56. This in turn, imparts a rotational force to fountain 10 causing the entire fountain unit to slowly rotate. The degree or speed of rotation in controlled by adjustment of valve 50.

Adjustment valve 55 is positioned within return coupling 95. In its normally closed position, valve 55 prevents water flow downwardly from tee 94 and causes the entire output of motor and pump 90 to be directed upwardly to produce upwardly directed water sprays such as sprays 129 or 130. However, the height of fountain spray produced may be reduced by opening spray adjustment valve 55. As valve 55 is opened, a portion of the water flow output of motor and pump 90 is returned through return coupling 95 into intake chamber 80. The proportionate part of returned water flow and reduction of upwardly directed flow in controlled by adjusting valve 55. As a result, the height of fountain spray produced by fountain 10 may be controlled.

It will be apparent to those skilled in the art that the physical arrangement of components within the pool fountain are, to some extent, a matter of design choice. The overall objective of component location is directed toward maintaining upright orientation and buoyancy. Thus, different numbers of fountainheads, lights, batteries or battery sizes as well as pump 90 and other components may be used without departing from the spirit and scope of the present invention.

The present invention, can e fabricated in various models having different options. For example, a simple unit having one fountainhead and one light and an on/off switch with remote control may be provided. Alternatively, the unit may include other fountainheads, lights and accessories.

FIG. 3 sets forth a perspective assembly view of the interior components within spray housing 100 which cooperate to provide selective water flow through either fountain nozzle 51, 52 or 53 (nozzles 51 through 53 seen in FIG. 1). A tube plate 135 is secured within spray housing 100 by conventional attachment (not shown) and defines a plurality of apertures 142, 143 and 144. Apertures 142, 143 and 144 are coupled to upwardly extending nozzle tubes 102, 103 and 104 respectively. As described above, nozzle tubes 102, 103 and 104 are in turn coupled to fountain nozzles 51, 53 and 52 respectively.

A gear drive unit 106 is coupled to a motor 105 and includes an output shaft 107. As described above, shaft 107 is rotated at a selected speed through the action of gear drive unit 106 each time motor 105 is activated. Stationary tube plate 135 defines an aperture 136 through which shaft 107 extends. Rotating plate 115 defines an aperture 116 which receives the lower end of shaft 107. A conventional fastener 118 secures the lower end of shaft 107 to rotating plate 115. Rotating plate 115 further defines an aperture 117.

In addition, and with return to FIG. 1, a water tube 85, coupled to pump 90, provides a pressurized flow of water to a plurality of nozzles 87 through a passage (not shown) formed in a ring 86 of spacer ring 60. This provides further fountain action. Preferably, spacer ring 60 is moved upwardly upon housing 20 when this feature is used.

In operation, rotating plate 115 and tube plate 135 are positioned against each other within spray housing 100 (seen in FIG. 2). Shaft 107 passes loosely through aperture 136 and is secured to rotating plate 115 through aperture 116 and fastener 118. The rotational position of plate 115 with respect to apertures 142, 143 and 144 of tube plate 135 controls the flow of water upwardly through aperture 117 and a selected one of nozzle tubes 102, 103 and 104. If for example, motor 105 rotates plate 115 such that aperture 117 is aligned with aperture 142 of tube plate 135, water flow will pass upwardly through nozzle tube 102 and produce a fountain spray directed upwardly from fountain nozzle 51. Conversely, the rotation of plate 115 to an alignment with aperture 143 causes water flow to pass upwardly through nozzle tube 103 and produce an upwardly directed fountain spray from fountain nozzle 53 (seen in FIG. 2). Similarly, rotation of plate 115 to align aperture 117 with aperture 144 causes upwardly directed water flow through nozzle tube 104 thereby producing a fountain spray upwardly directed from fountain nozzle 53 (seen in FIG. 1). In this manner, the cooperation of rotating plate 115 and stationary tube plate 135 in response to motor 105 and gear drive unit 106 provides selection between alternative fountain nozzles and different spray patterns.

FIG. 4 sets forth a partial section view of a water flow control mechanism constructed in accordance with an alternate embodiment of the present invention. With temporary return to FIG. 2, it will be understood that the water flow control mechanism shown in FIG. 4 replaces the operative structure of spray housing 100, rotating plate 115 and stationary plate 135. It will be further understood that nozzle tubes 102, 103 and 104 are shaped somewhat differently but perform the identical function of communicating water flow to fountain nozzles 51, 52 and 53 (seen in FIG. 1).

Returning to FIG. 4, water flow input 101 is coupled to an end plug 145 having a passage 148 formed therein. A generally cylindrical closed end cap housing 138 is secured to end plug 145 in a water tight attachment. Housing 138 is joined to nozzle tubes 102, 103 and 104. Correspondingly, housing 138 defines water flow apertures 139, 140 and 141 respectively, each aligned with a corresponding one of nozzle tubes 102, 103 and 104. A generally cylindrical closed end rotor 146 is rotatably supported within the interior of housing 138 and defines a water flow aperture 147. Gear drive housing 106 and motor 105 are supported above housing 138 by conventional support means (not shown) which may, for example, include fixed attachment to housing 138. The upper end of rotor 146 is coupled to the lower end of shaft 107 extending downwardly from gear unit 106. The engagement of shaft 107 with the upper end of rotor 146 ensures that rotor 146 is rotated when motor 105 is energized. An O-ring seal 148 provides water tight seal between the upper rotatable portion of rotor 146 and housing 138. In addition, gear drive unit 106 supports a cam 158 which is set forth below in FIG. 5 in greater detail. A cam switch 157 is operatively coupled to cam 158 in the manner also set forth below in FIG. 5.

In operation, when motor 105 is energized, gear drive unit 106 provides rotational coupling of motor 105 to shaft 107. Correspondingly, rotation of shaft 107 provides rotation of rotor 146 within housing 138. The rotation of rotor 146 within housing 138 provides movement of water flow aperture 147 between the position shown in FIG. 4 in which aperture 147 is aligned with aperture 140 of nozzle tube 103 and alternative positions in which aperture 147 is sequentially aligned with aperture 139 of nozzle tube 102 and aperture 141 of nozzle tube 104. As a result, water flow is allowed to flow for a period of time through each of nozzle tubes 102, 103 and 104 as rotor 146 is rotated by motor 105, gear drive unit 106 and shaft 107.

FIG. 5 sets forth a partial section view of gear drive unit 106 taken along section lines 5—5 in FIG. 4. As described above, a cam 58 is rotatably supported upon a shaft 107. As is also described above, shaft 107 is rotated by gear drive 106 and motor 105 (seen in FIG. 4). Cam 158 defines a plurality of outwardly extending cam lobes 159, 160 and 161. A cam switch 157 is operatively coupled to the motor control circuit shown in FIG. 6. Suffice it to note here, that actuation of cam switch 157 by any one of cam lobes 159, 160 or 161 interrupts the operation of motor 105 (seen in FIG. 4) and terminates the rotation of cam 158 and the change of water flow between the nozzle tubes shown in FIGS. 3 and 4. It will be noted, that gear drive unit 106 (shown in FIGS. 3 and 4) includes cam 158 and cam switch 157 for both of the water flow control apparatus shown in FIGS. 3 and 4.

In operation, as shaft 107 rotates cam 158, cam switch 157 is inactive between cam lobes and is actuated as each cam lobe approaches the cam switch. Thus, between cam lobes, the rotation of cam 158 once initiated by the motor control apparatus shown in FIG. 6 continues until the next cam lobe actuates cam 157. Thus, in the embodiment of FIG. 5 in which three cam lobes are provided, cam switch 157 is actuated three times per revolution of cam 158. In the preferred embodiment of the present invention, the cooperation of cam switch 157 and cam 158 are utilized by the motor control circuit shown in FIG. 6 to ensure that the termination of water flow switching in response to a fountainhead selection signal in the manner described above, occurs at each of the three positions corresponding to the cam lobes. In this manner, the motor control allows the rotation of cam 158 and rotor 146 (seen in FIG. 4) or rotating plate 115 in the embodiment shown in FIG. 3 to stop only in positions in which alignment is provided between one of the nozzle tubes. In other words, the cooperation of cam switch 157 and cam 158 ensures that the flow control selector will not stop between alignment positions with the nozzle tubes.

Figure 6:
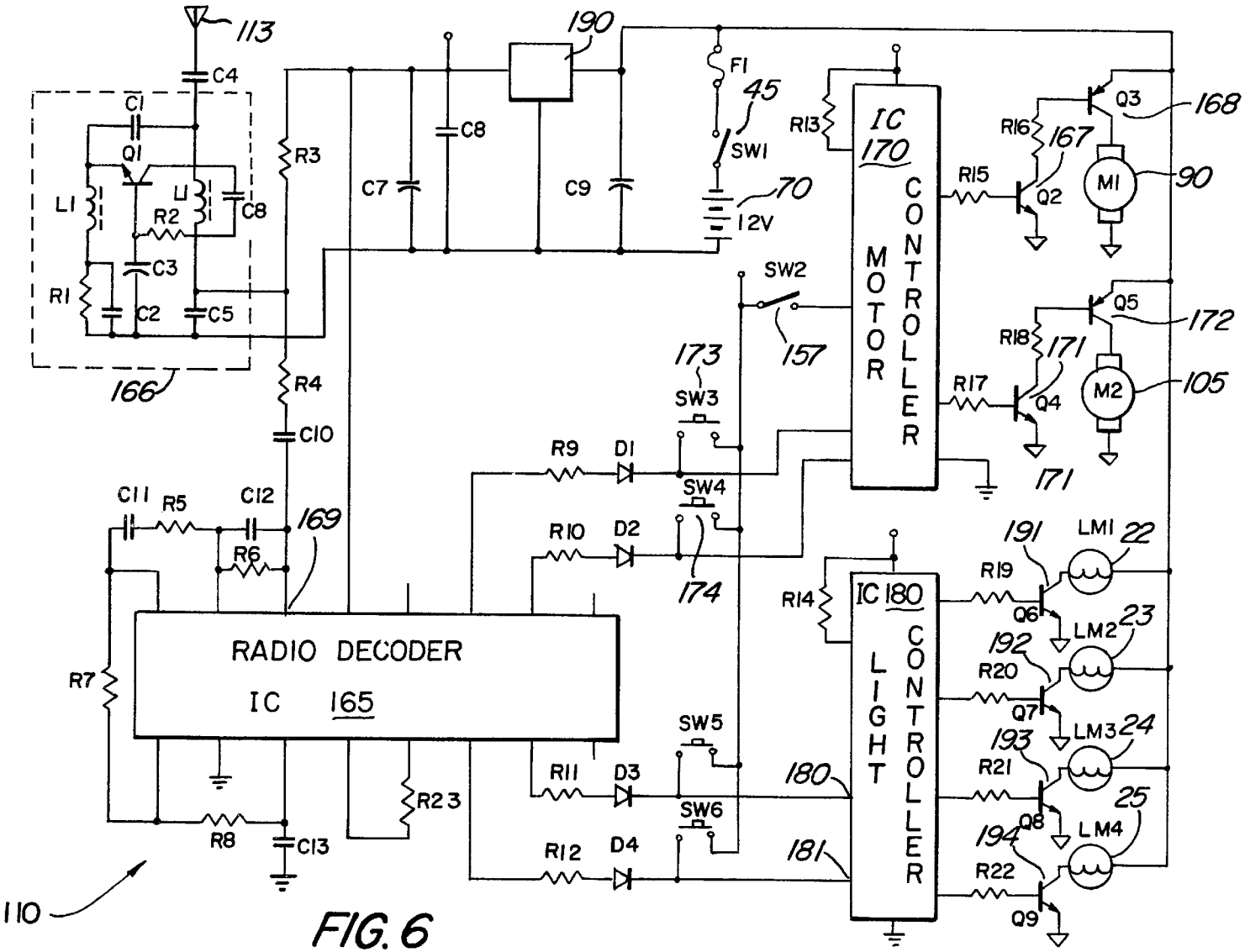
FIG. 6 sets forth a schematic diagram of the controller of the present invention.

FIG. 6 sets forth a schematic diagram of control circuit 110. As mentioned above, control circuit 110 may be fabricated in accordance with conventional fabrication techniques, and thus may be fabricated utilizing commercially available circuit components. Accordingly, control circuit 110 includes an input amplifier 166 utilizing a tuned radio frequency input stage coupled to an antenna 113. Input amplifier 166 is conventional in fabrication and utilizes an NPN transistor together with conventional tuning inductive and copasitive elements. The output of input amplifier 166 is coupled to an input terminal 169 of a RF signal decoder integrated circuit 165. Integrated circuit 165 is conventional in fabrication and in the embodiment shown in FIG. 6, is provided by a device manufactured by REALTEK device number RX2 integrated circuit. However, other equivalent integrated circuit devices may be utilized for providing the function of radio frequency signal decoder operation. The essential function of integrated circuit 165, is to convent the applied radio frequency signals at input 169 to digitally encoded signals which may utilized in controlling the plurality of motors and lamps within the present invention pool fountain.

Thus, an integrated circuit motor controller 170, which in the embodiment of FIG. 6, may comprise a conventional 4-bit microcontroller is operatively coupled to the output signals of integrated circuit 165. A switch 157, which as is better seen in FIG. 5, is operated by a cam 158 and is operatively coupled to integrated circuit 170. The function of switch 157 is to provide the termination of fountainhead switching set forth above in FIGS. 3 and 4 and described therein.

Motor control integrated circuit 170 is operatively coupled to a pair of amplifiers 167 and 171. Amplifier 167 serves as a preamplifier for a power amplifier transistor 168. Transistor 168 operatively controls pump motor 90. Similarly, amplifier 171 provides a preamplifier stage driving a power amplifier 172 which in turn controls the operation of flow control motor 105. Thus, in response to output signals from integrated circuit 165, motor control IC 170 operates pump motor 190 and flow control motor 105, in response to manual switch inputs or remote control signal inputs in the manner described above.

An integrated circuit light controller 180 which in the embodiment shown in FIG. 6, is provided by a conventional 4-bit microcontroller includes a pair of inputs 180 and 181 coupled to decoder integrated circuit 165. Integrated circuit 180 is operatively coupled to a plurality of switching transistors 191, 192, 193 and 194. Transistors 191 through 194 are coupled to light assemblies 22, 23, 24 and 25 respectively. The operation of transistors 191 through 194 is that of a simple switch, such that an output signal from integrated circuit 180 turns on the selected one of transistors 191 through 194. Each time one of transistors 191 through 194 is turned on, the corresponding light assembly is energized and provides the above described illumination. Thus, in response to decoded signals received from input amplifier 166 and decoded by integrated circuit 165, integrated circuit 180 controls transistors 191 through 194 to energize selected ones of light assemblies 22 through 25.

Figure 7:
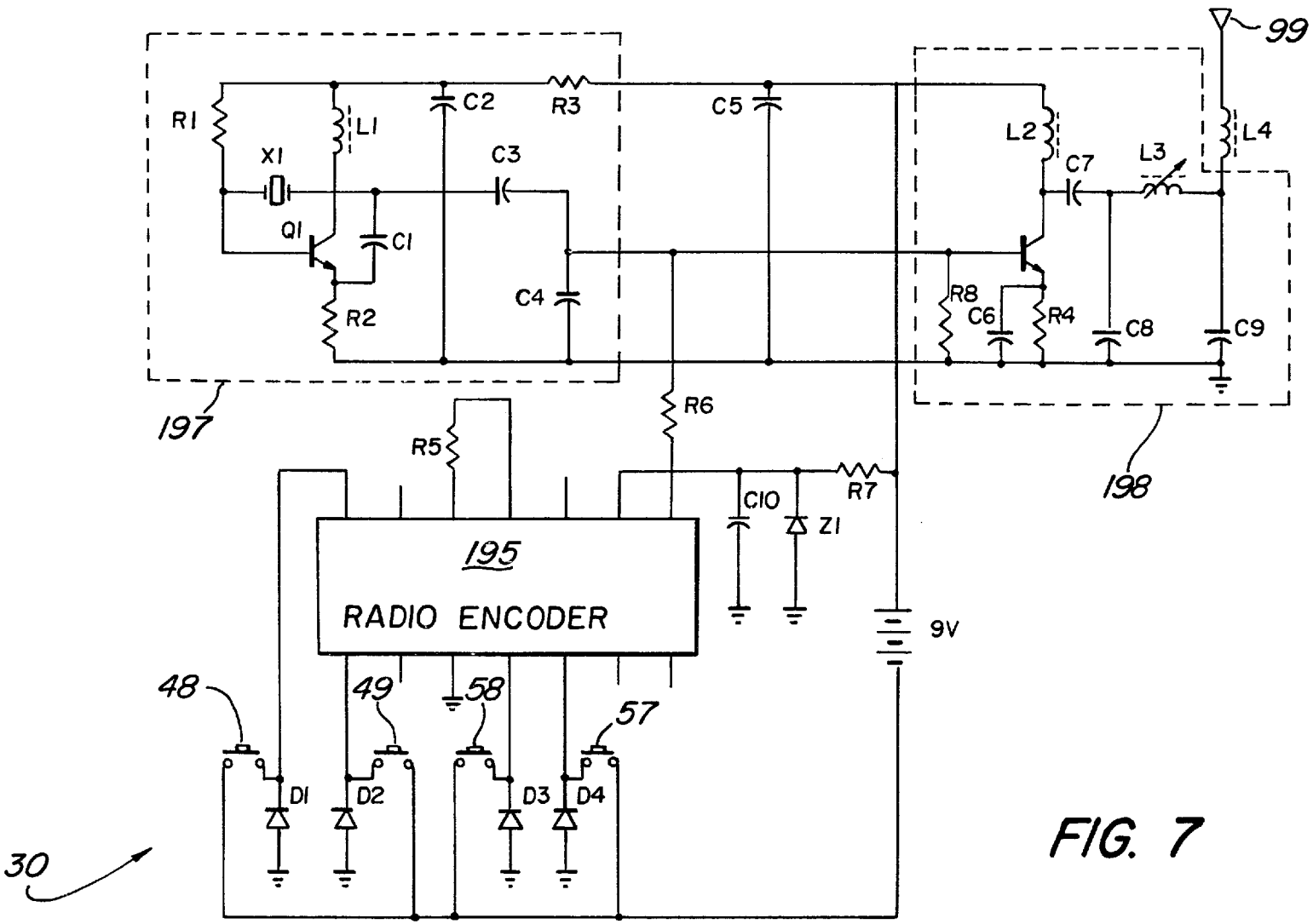
FIG. 7 sets forth a schematic diagram of the remote unit of the present invention pool fountain.

FIG. 7 sets forth a schematic diagram of the operative circuit within remote control unit 30. As mentioned above, remote control unit 30 utilizes a conventional four command remote control circuit which may be fabricated entirely in conventional fabrication techniques. The four command inputs described above are provided by user operated switches 48, 49, 57 and 58. An integrated circuit encoder 195 is conventional in fabrication and in the embodiment of FIG. 7, utilizes an integrated circuit manufactured by REALTEK device number TX2. However, it will be apparent to those skilled in the art that different integrated circuits having the signal encoder function of integrated circuit 195 may be utilized without departing from the spirit and scope of the present invention. Integrated circuit 195 responds to the actuation of any of switches 48, 49, 57 or 58 to produce a corresponding digitally encoding output signal at output 196.

A radio frequency oscillator 197 utilizes a conventional crystal controlled oscillator producing a radio frequency output signal. Accordingly, the digitally encoded signal from integrated circuit 195 is coupled to the output of radio frequency oscillator 197. The combination of digitally encoded control signal and the radio frequency output signal of oscillator 197 is applied to a tuned amplifier stage 198. Amplifier stage 198 is conventional in fabrication and comprises a tuned amplifier stage having optimal power gain for a predetermined bandwidth of radio frequency signals. In further accordance with conventional fabrication, the combined signal input from encoder 195 and oscillator 197 is amplified within tuned amplifier 198 and is transmitted from antenna 199. The digitally encoded signal from antenna 199 is received by antenna 113 of control circuit 110 (seen in FIG. 6) where it is decoded and utilized in controlling the operation of the present invention pool fountain.

FIG. 8 sets forth a perspective view of an alternate embodiment of the present invention generally referenced by numeral 150. Pool fountain 150 is set forth to illustrate an alternate embodiment of the present invention by which the physical appearance of the present invention pool fountain may resemble a shape substantially different from pool fountain 10 set forth in FIG. 1. Thus, by way of example and not limitation, pool fountain 150 includes a body portion 153 which is operatively coupled to lower housings 151 and 152. In the example of FIG. 8, body 153 is generally shaped to resemble a creature such as a duck, bird or other animal. However, it will be understood by those skilled in the art that body 153 may be shaped in a variety of appearances such as fish, dolphins or other creatures without departing from the spirit and scope of the present invention.

Thus, body 153 supports a plurality of upwardly directed fountain nozzles 154 and a plurality of upwardly directed lights 155. It will be understood by those skilled in the art that nozzles 154 and lights 155 are operatively coupled to housings 151 and 152 in the same manner as set forth above in pool fountain 10. Thus, during operation, one or more of nozzles 154 is caused to produce an upwardly directed stream of water spray and lights 155 are operated in the manner described above to provide upwardly directed illumination beams for further effect. The importance of the embodiment of FIG. 8, is to illustrate that the present invention pool fountain may be fabricated in a variety of aesthetic themes without departing from the spirit and scope of the present invention.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A pool fountain for use in a pool of water, said pool fountain comprising:

a flotation housing having buoyancy for floating in water;

a battery housing, supported by said flotation housing, having a battery power supply;

a pump motor and pump supported within said flotation housing, said pump drawing water into said flotation housing and producing a pressurized water flow when said pump motor is activated;

a water spray mechanism having a plurality of upwardly directed fountain nozzles, said water spray mechanism being supported within said flotation housing and having spray selection means coupled to said pump directing said pressurized water flow upwardly to selected ones of said fountain nozzles to produce upwardly directly fountain spray;

a light source supported by said flotation housing coupled to said battery power supply and operative to illuminate said fountain spray;

a controller supported within said flotation housing having means for receiving control signals and for operating said pump motor, said spray selection means and said light source; and a remote control unit for producing said control signals.

2. The pool fountain set forth in claim 1 wherein said spray selection means includes:

a plurality of nozzle tubes each coupled to one of said fountain nozzles; and a water flow controller having a housing coupled to said nozzle tubes and receiving said pressurized water flow and a movable water flow diverter for selectively causing water flow to one of said nozzle tubes.

3. The pool fountain set forth in claim 2 wherein said flotation housing defines a lower portion and wherein said battery housing is secured to said lower end.

4. The pool fountain set forth in claim 3 further including a rotation valve supported by said flotation housing having a discharge port, said rotation valve being coupled to said water flow controller such that opening said rotation valve produces a lateral water flow through said discharge port causing said pool fountain to rotate.

5. The pool fountain set forth in claim 4 further including a spacer ring having an outer ring and means for supporting said outer ring upon said flotation housing.

6. The pool fountain set forth in claim 5 further including an anchor and a tether for securing said battery housing to said anchor.

7. For use in a pool of water, a pool fountain comprising:

a housing defining a buoyant portion and an upper plate;

a plurality of fountain nozzles supported by said upper plate;

a plurality of light assemblies supported by said upper plate;

a battery-powered pump producing a water flow coupled to said fountain nozzles for producing an upwardly directed fountain spray;

a remote control unit producing control signals;

nozzle switching means coupled to said fountain nozzles and said pump operative to direct said pump water flow to selected ones of said fountain nozzles; and a controller supported within said housing receiving said control signals and activating said battery-powered pump, said nozzle switching means and said light assemblies in response to said control signals.

8. The pool fountain set forth in claim 5 wherein said outer ring includes a plurality of decorative accessories secured to said outer ring.

9. The pool fountain set forth in claim 8 wherein said decorative accessories are formed to resemble fish and are tethered to said outer ring.

10. The pool fountain set forth in claim 7 wherein said housing is fabricated of a photo-luminescent material.

11. The pool fountain set forth in claim 7 wherein said housing supports a photo-luminescent paint coating.

12. The pool fountain set forth in claim 7 wherein said housing defines a general shape corresponding to an animal.

13. The pool fountain set forth in claim 7 wherein said housing supports a decorative element.

14. A pool fountain for use in a pool of water, said pool fountain comprising:

a flotation housing having buoyancy for floating in water;

a battery housing, supported by said flotation housing and producing a pressurized water flow when said pump motor is activated;

a water spray mechanism supported within said flotation housing coupled to said pump directing said pressurized water flow upwardly to produce an upwardly directed fountain spray, said water spray mechanism including a plurality of upwardly directed fountain nozzles, a plurality of nozzle tubes each coupled to one of said fountain nozzles, and a water flow controller having a housing coupled to said nozzle tubes and receiving said pressurized water flow and a movable water flow diverter for selectively causing water flow to one of said nozzle tubes;

a light source supported by said flotation housing coupled to said battery power supply and operative to illuminate said fountain spray;

a controller supported within said flotation housing having means for receiving control signals and for operating said pump motor and said light source; and a remote control unit for producing said control signals.

15. The pool fountain set forth in claim 14 wherein said flotation housing defines a lower portion and wherein said battery housing is secured to said lower end.

16. The pool fountain set forth in claim 15 further including a rotation valve supported by said flotation housing having a discharge port, said rotation valve being coupled to said water flow controller such that opening said rotation valve produces a lateral flow through said discharge port causing said pool fountain to rotate.

17. The pool fountain set forth in claim 16 further including a spacer ring having an outer ring and means for supporting said outer ring upon said flotation housing.

18. The pool fountain set forth in claim 17 further including an anchor and a tether for securing said battery housing to said anchor.

19. The pool fountain set forth in claim 7 wherein said plurality of light assemblies includes lights having different colors and wherein said controller selectively activates said differently colored lights in response to said control signals.

20. The pool fountain set forth in claim 19 wherein said controller includes program means for operating said differently colored lights, said pump and said nozzle switching means in accordance with a stored program.

21. The pool fountain set forth in claim 19 further including a plurality of switches supported by said housing operatively coupled to said controller to manually control said pump, said nozzle switching means and said light assemblies, said switches being operable by persons with,a host swimming pool.

22. The pool fountain set forth in claim 16 further including a fountain spray height control valve which is coupled to said battery-powered pump and which is adjustable to vary the portion of water flow through said noggles.

23. The pool fountain set forth in claim 7 wherein said housing includes a vent valve defining a normally open condition and a closed condition when said vent valve is submerged due to submerging of said pool fountain.

24. The pool fountain set forth in claim 7 further including a master switch coupled to said battery-powered pump and supported upon said housing, said master switch being operative when said pool fountain is removed from water and rested upon a surface to deactivate said pool fountain.

* * * * *